US007580539B2

(12) United States Patent
Tachikawa

(10) Patent No.: US 7,580,539 B2
(45) Date of Patent: Aug. 25, 2009

(54) COMPACT FOLDABLE HEADPHONE

(75) Inventor: Yoshinori Tachikawa, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 795 days.

(21) Appl. No.: 11/221,722

(22) Filed: Sep. 9, 2005

(65) Prior Publication Data

US 2006/0062417 A1 Mar. 23, 2006

(30) Foreign Application Priority Data

Sep. 17, 2004 (JP) ..... 2004-271761

(51) Int. Cl.
*H04R 25/00* (2006.01)

(52) U.S. Cl. ..... 381/374; 381/379

(58) Field of Classification Search ..... 2/209; 181/129; 379/430; 381/370, 374, 376, 377, 381/378, 379, 381, 383
See application file for complete search history.

(56) References Cited

U.S. PATENT DOCUMENTS 7,172,052 B2 * 2/2007 Lenhard-Backhaus ..... 381/370

FOREIGN PATENT DOCUMENTS

JP 2000-125386 4/2000

* cited by examiner

*Primary Examiner*—Brian Ensey
(74) *Attorney, Agent, or Firm*—Manabu Kanesaka

(57) ABSTRACT

A headphone is made handy for carrying or storing. The headphone includes a pair of right and left headphone units, and an elastic band formed substantially into a U shape, which is mounted ranging from the human head to both sides of the head, and supports the headphone units in end portions thereof. A multiaxial arm joint is provided between an end part of the elastic band and the headphone unit, and includes a first arm, one end of which is connected turnably to the end part of the elastic band, and a second arm, one end of which is connected turnably to the other end of the first arm and the other end of which is connected turnably to the headphone unit. By turning the connecting portions of the multiaxial arm joint, the headphone units are housed within an internal space encircled by the elastic band.

5 Claims, 7 Drawing Sheets

COMPACT FOLDABLE HEADPHONE

TECHNICAL FIELD

The present invention relates to a headphone which can be folded in a compact form when being not in use so as to be handy for carrying or storing, and also can provide a good sense of mounting when being mounted for use.

BACKGROUND ART

Conventionally, some headphones which can be folded in a compact form when being carried or stored have been proposed as disclosed, for example, in Patent Document 1 (Japanese Patent Application Publication No. 2000-125386).

As its basic form, the headphone includes an elastically deformable headband formed substantially into a U shape, which is mounted ranging from the human head's crown to both sides of the head, and a pair of headphone units supported at both ends of the headband. In the headphone described in the aforementioned Patent Document 1, the headband is made foldable by means of a hinge in a central portion of the headband, and the headphone units are connected to the ends of the headband so as to be turnable.

According to this configuration, the headphone can be folded in a compact form when being carried or stored as shown in FIG. 16 in the aforementioned Patent Document 1.

However, in the above-described conventional art, the headphone has a structure in which the headband is divided into two pieces in a central portion therefore, and these divided portions are connected to each other turnably by a hinge. Therefore, a pressing force toward the ear side, which acts on the headphone unit side via the headband, is weak, so that the headphone unit sometimes slips down or comes off during the use of the headphone.

To overcome this problem, in the above-described conventional art, an aural hook portion is provided on the headphone unit. Accordingly, however, the structure becomes complicated, and this configuration is also unfavorable in terms of cost. Also, upon mounting the headphone, it is necessary to put the aural hook portion on an auricle after the headband has been mounted on the head, which presents a problem of troublesome mounting operation.

SUMMARY OF THE INVENTION

Accordingly, an object of the present invention is to provide a headphone which can be folded in a compact form when being not in use though the mounting properties are not sacrificed and the construction is simple.

To achieve the above object, the present invention provides a headphone including a pair of right and left headphone units and an elastic band formed substantially into a U shape, which is mounted ranging from the human head's crown to both sides of the head, and supports the headphone units in end portions thereof, wherein between an end part of the elastic band and the headphone unit, there is provided a multiaxial arm joint including a first arm one end of which is connected turnably to the end part of the elastic band and a second arm one end of which is connected turnably to the other end of the first arm and the other end of which is connected turnably to the headphone unit; and by turning the connecting portions of the multiaxial arm joint, the headphone units are housed within an internal space encircled by the elastic band from a state in which the headphone is mounted on the head.

According to this configuration, between the end part of the elastic band and the headphone unit, there is provided a multiaxial arm joint including a first arm one end of which is connected turnably to the end part of the elastic band and a second arm one end of which is connected turnably to the other end of the first arm and the other end of which is connected turnably to the headphone unit. Thereby, the headphone units are housed in the internal space encircled by the elastic band by a simple folding work, so that the whole of the headphone can be made compact.

According to a preferred mode of the present invention, the one end side of the first arm is connected to the end part of the elastic band so that the first arm can be turned toward the internal space side of the elastic band; the one end side of the second arm is connected to the other end of the first arm so that, in the internal space of the elastic band, a sound radiating surface of an ear pad of the headphone unit can be turned so as to be directed rearward from a position at which the sound radiating surface faces to the ear side when the headphone is mounted for use; and the headphone unit is connected to the other end side of the second arm so that the sound radiating surface of the ear pad can be turned along a plane direction at the time when the headphone is mounted for use.

According to this configuration, since a proper pressing force is given to the human body's ear by the elastic band, the headphone unit does not need an auxiliary means such as an aural hook portion. Also, the headphone unit is connected to the other end side of the second arm so that the sound radiating surface of the ear pad can be turned along a plane direction at the time when the headphone is mounted for use. Thereby, when the headphone is mounted for use, the position of the headphone can be adjusted as the user likes, and hence a good sense of fitness can be obtained.

Also, according to a preferred mode of the present invention, the second arm has a dimension longer than that of the first arm; a curved portion expanding forward when the headphone is mounted for use is formed in an intermediate part of the second arm; and a turnable connecting means is provided between the inside of the other end of the second arm and the outer peripheral end surface of the headphone unit.

According to this configuration, the second arm has a dimension longer than that of the first arm; the curved portion expanding forward when the headphone is mounted for use is formed in the intermediate part of the second arm; and the turnable connecting means is provided between the inside of the other end of the second arm and the outer peripheral end surface of the headphone unit. Thereby, the headphone unit can be moved more smoothly.

Also, according to a preferred mode of the present invention, between the end portion of the elastic band and one end of the first arm, there is provided the releasable positioning stopper for holding the first arm at the turning start position and the turning end position.

According to this configuration, between the end portion of the elastic band and one end of the first arm, there is provided the releasable positioning stopper for holding the first arm at the turning start position and the turning end position. Thereby, the positional relation of the first arm with respect to the elastic band at the time when the headphone is in use and the time when it is folded and stored can be made stable.

Also, according to a preferred mode of the present invention, the second arm is connected to the first arm so as to be turnable in a movable range of approximately 90 degrees.

According to this configuration, since the second arm is connected to the first arm so as to be turnable in a movable range of approximately 90 degrees, the optimum positions of the headphone at the time when the headphone is in use and the time when it is folded and stored can be secured easily.

DETAILED DESCRIPTION

Figure 1:
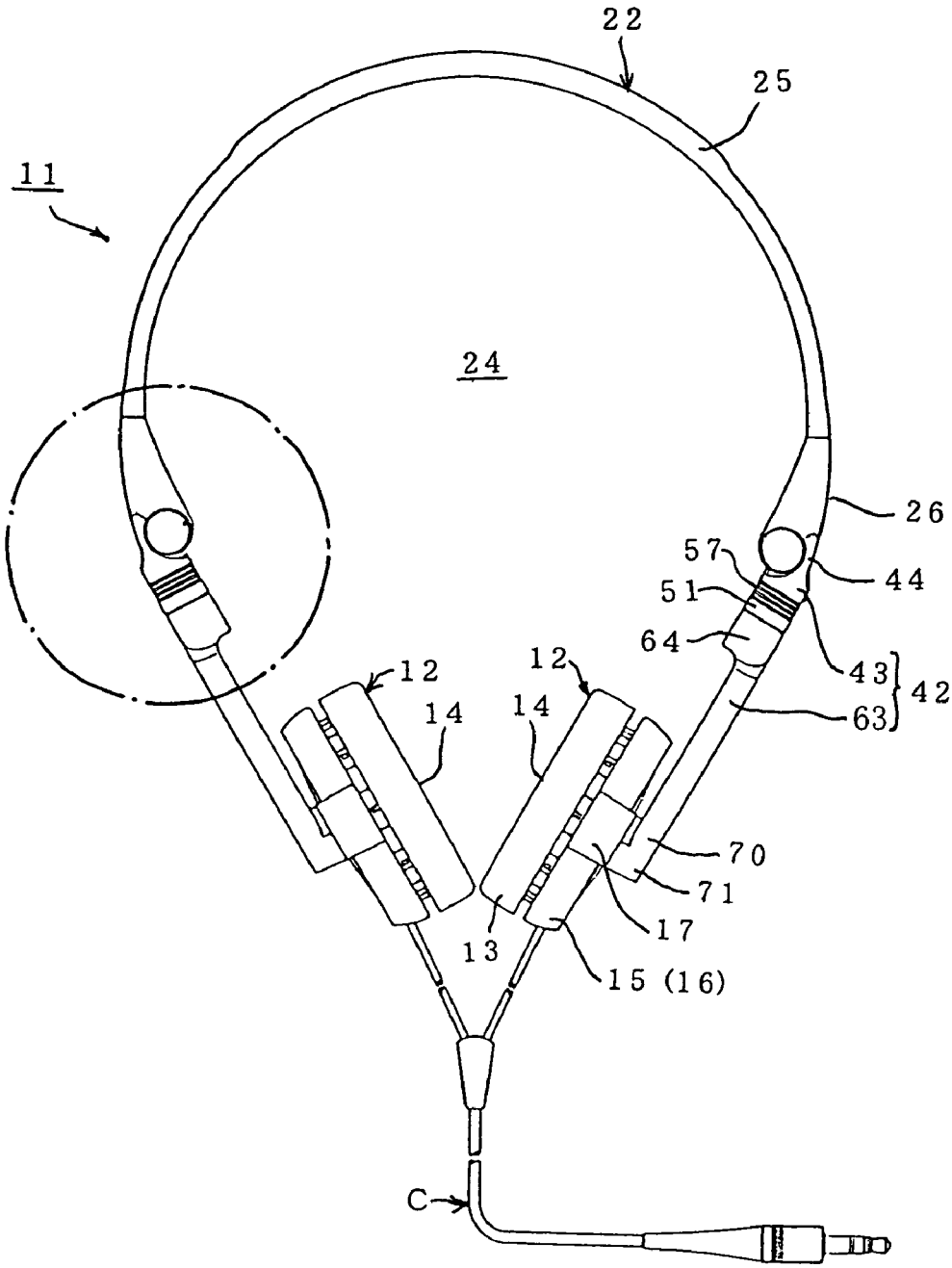
FIG. 1 is a front view showing one example of a headphone in accordance with the present invention.
Figure 2:
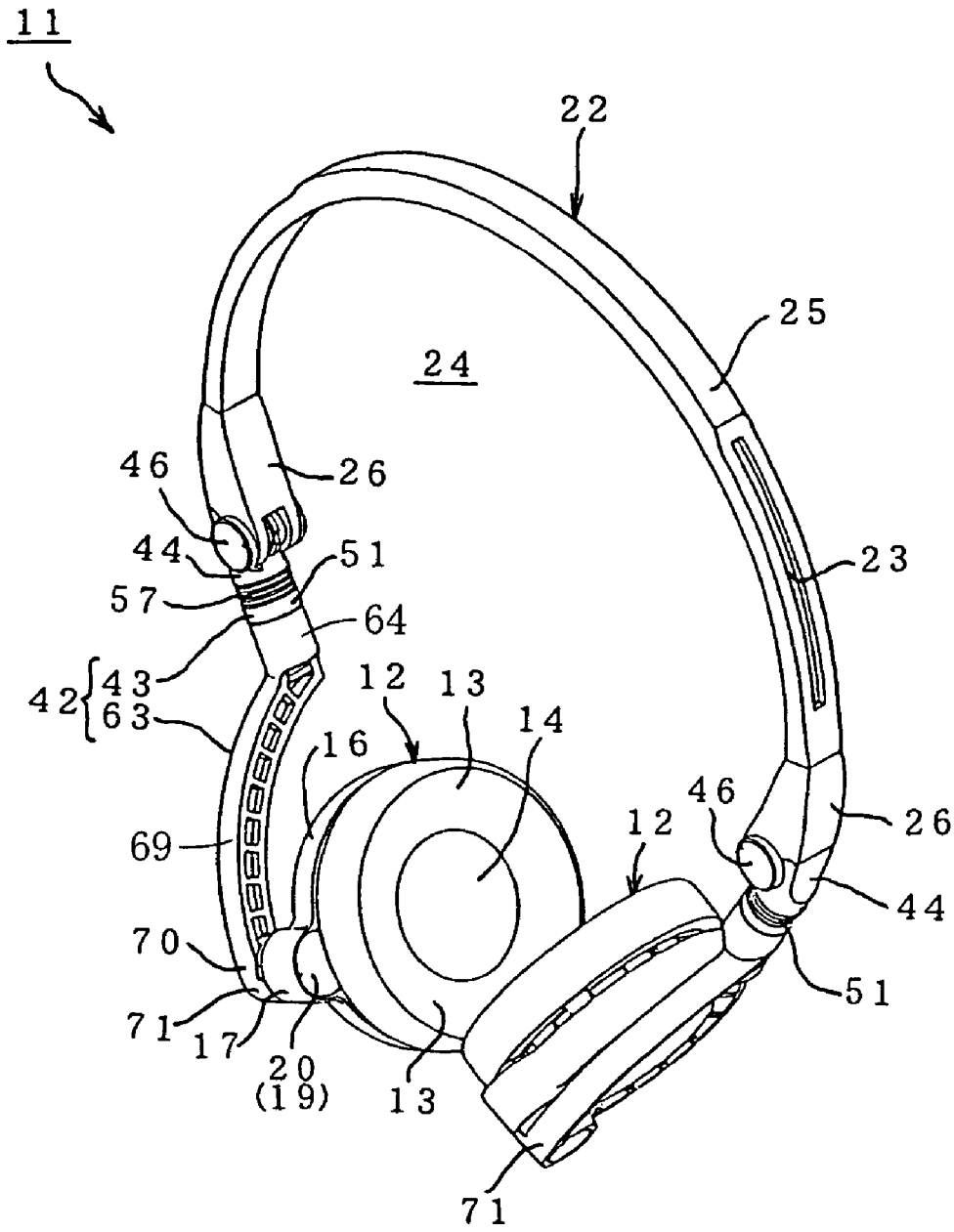
FIG. 2 is a perspective view of the headphone shown in FIG. 1.
Figure 3:
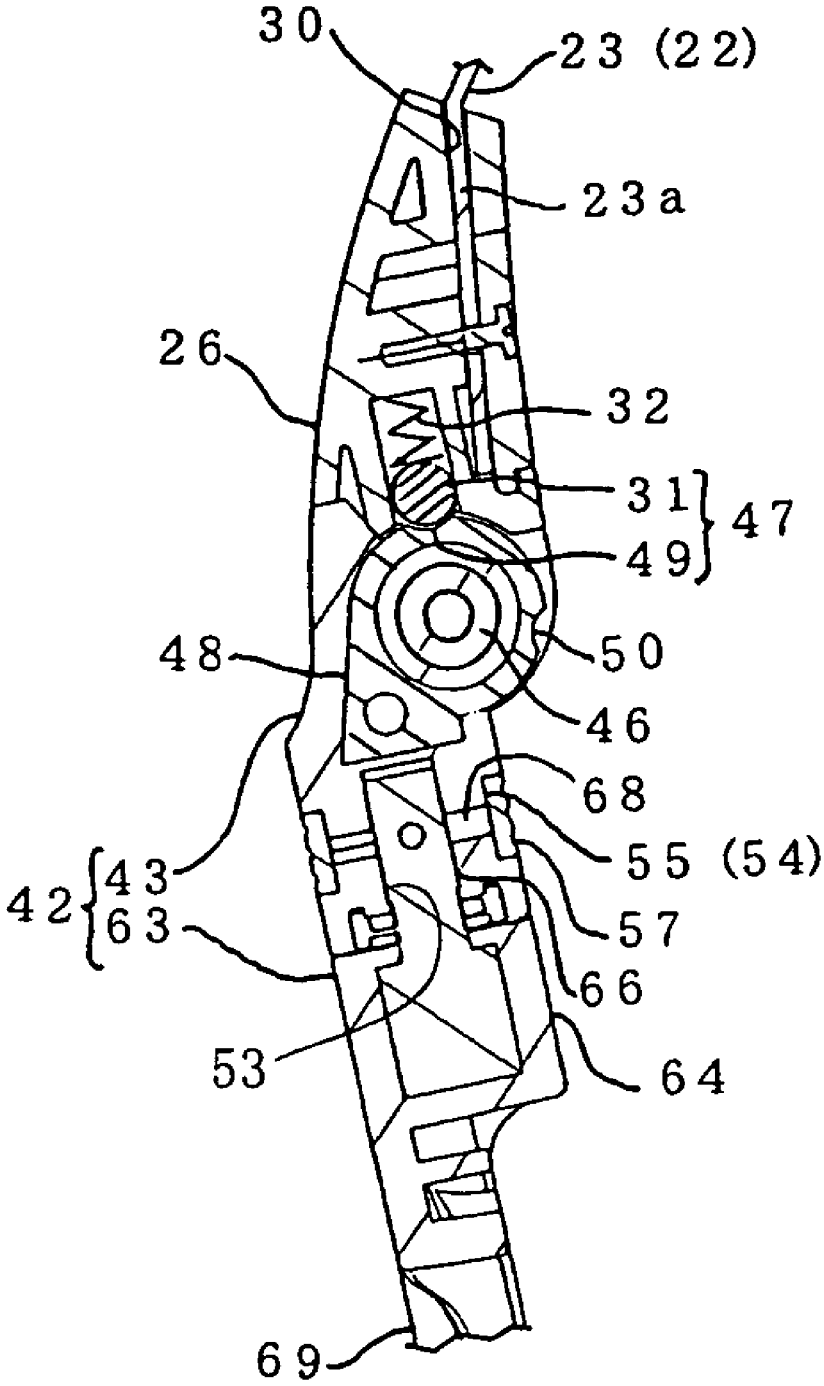
FIG. 3 is an enlarged sectional view of a portion encircled by a chain line in FIG. 1.

An embodiment of the present invention will now be described with reference to the accompanying drawings (FIGS. 1 to 8). In these figures, FIG. 1 is a front view showing one example of a headphone in accordance with the present invention, FIG. 2 is a perspective view of the headphone shown in FIG. 1, and FIG. 3 is an enlarged sectional view of a portion encircled by a chain line in FIG. 1.

Referring to FIGS. 1 to 3, as its basic form, a headphone 11 in accordance with the present invention includes a pair of right and left headphone units 12, 12 and a substantially U-shaped elastic band (headband) 22 which is mounted ranging from the human head's crown to both sides of the head (these are not shown) and supports the headphone units 12, 12 at both ends thereof. Reference character C in FIG. 1 denotes a connection cord.

The headphone units 12, 12 are supported by the elastic band 22 so as to come into contact with the human body's right and left ears with a proper pressing force. The elastic band 22 has a flexible band portion 23 so as to be curved substantially into a U shape with a radius of curvature determined from the relationship with the size of human head. As the flexible band portion 23, an elastically deformable band plate formed of a stainless steel material is preferably used.

When the headphone 11 is in use, the human head enters into an internal space 24 on the inside surrounded by the flexible band portion 23. Whereas, when the headphone is not in use, for example, when it is carried or stored, the headphone units 12, 12 are housed in the internal space 24.

In both end portions 23*a*, right and left, of the flexible band portion 23, an end portion 26, 26 is attached integrally. The end portion 26 serves as a holder member for the elastic band 22, and is formed of a synthetic resin material. In this example, the flexible band portion 23 is covered with a covering portion 25 formed of a cushioning material such as a rubber material excluding a part thereof, which provides a soft feel.

In the present invention, between the end portion 26, 26 of the elastic band 22 and the headphone unit 12, 12, there is provided a multiaxial arm joint 42, 42 including a short first arm 43 and a second arm 63 that is longer than the first arm 43.

One end 44 of the first arm 43 is connected turnably to the end portion 26 of the elastic band 22. One end 64 of the second arm 63 is connected turnably to the other end 51 of the first arm 43. The other end 70 of the second arm 63 is connected turnably with the headphone unit 12.

Since the multiaxial arm joint 42 is configured so that the connecting portions thereof are formed turnably, the paired right and left headphone units 12 can be housed including the multiaxial arm joint 42,42 in the internal space 24 of the elastic band 22 in a compact form. It is to be noted that the multiaxial arm joints 42, 42 have the same construction except that they are laterally symmetrical.

To the end portion 26 of the elastic band 22, one end of the first arm 43 included in the multiaxial arm joint is connected turnably toward the internal space 24 side of the elastic band 22.

Figure 4:
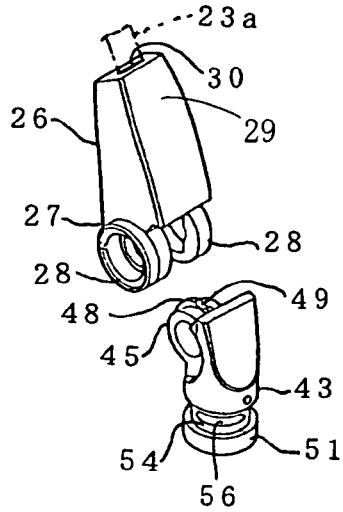
FIG. 4 is an exploded perspective view showing a connecting portion between an end part of an elastic band and a first arm of a multiaxial arm joint.

Specifically, as shown in FIG. 4, in a bottom portion 27 of the end portion 26 of the elastic band 22, a pair of bearing rings 28 are arranged so as to be separated in the front-and-rear direction of FIG. 1. On the top end 29 side of the end portion 26, there is formed a holding hole 30 into which the end portion 23*a* of the flexible band portion 23 is inserted to be fixed by a screw.

Figure 7:
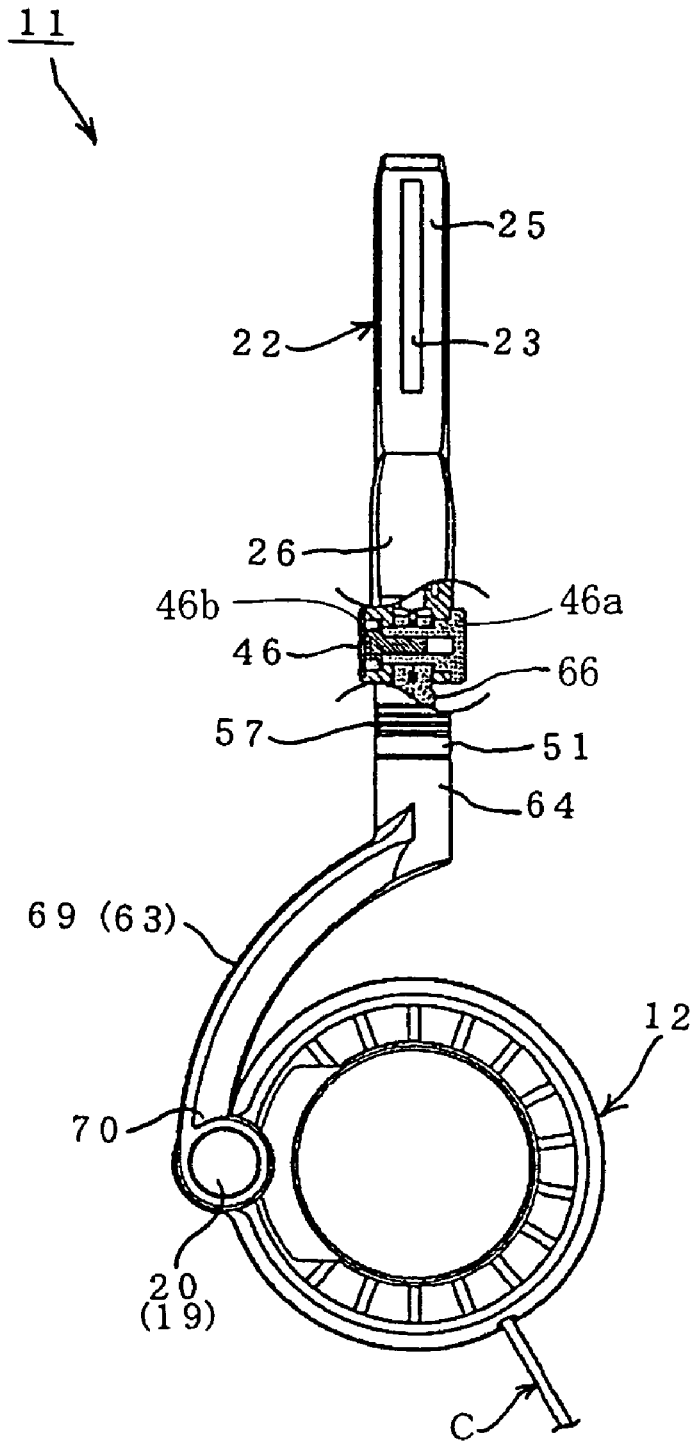
FIG. 7 is a partially sectioned left side view of the headphone shown in FIG. 1.

On the other hand, in the one end portion 44 of the first arm 43, a bearing ring 45, which is arranged between the bearing rings 28, 28, is formed, and the bearing rings 28 and 45 are positioned coaxially. As shown in FIG. 7, a rotating support shaft 46 including a female screw portion 46*a* and a male screw portion 46*b* is inserted in the bearing rings 28 and 45, by which the first arm 43 is connected to the end portion 26 of the elastic band 22 so as to be turnable toward the internal space 24 side of the elastic band 22.

As a preferred mode, the present invention includes a releasable positioning stopper 47 for holding the first arm 43 at a turning start position at the time when the headphone is in use and a turning end position at the time when the headphone is not in use, for example, when it is stored.

As shown in FIGS. 3 and 4, the bearing ring 45 of the first arm 43 has a rib 48 formed along the circumferential direction, and the rib 48 is formed with grooves 49 and 50 as one constructional element included in the positioning stopper 47. One groove 49 determines the turning start position, and the other groove 50 determines the turning end position. The grooves 49 and 50 are shifted from each other, for example, through about 110 degrees.

On the other hand, within the end portion 26 of the elastic band 22, an engagement body 31, which consists of, for example, a spherical body urged toward the rib 48 side by a helical compression spring 32, is provided as the other constructional element included in the positioning stopper 47.

The engagement body 31 engages with either one of the grooves 49 and 50 with a predetermined clicking force at the turning start position and the turning end position of the first arm 43. By compulsorily turning the first arm 43 from the engagement position thereof, the engagement body 31 is allowed to ride on the rib 48 from the groove 49 or the groove 50 against the urging force of the helical compression spring 32, and hence the restraint on the first arm 43 is lifted.

Figure 5:
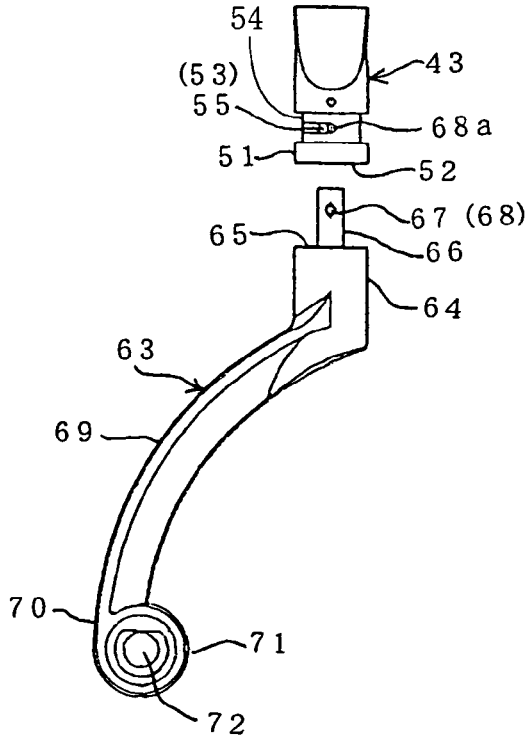
FIG. 5 is a side view showing a connecting portion between first and second arms of a multiaxial arm joint.

As shown in FIGS. 3 and 5, the one end portion 64 of the second arm 63 is connected to the other end portion 51 of the first arm 43 so as to be turnable around an axis perpendicular to the rotating support shaft 46. This connection is made to turn a sound radiating surface 14 of an ear pad 13 of the headphone unit 12 supported on the second arm 63 through at least 90 degrees from a position at which the sound radiating surface 14 faces to the ear side when the headphone is mounted (when the headphone is in use) and thus to make the sound radiating surface 14 in parallel with a plane including the internal space 24.

Specifically, a connecting shaft 66 perpendicular to the rotating support shaft 46 is projectingly provided on a top face 65 of the one end portion 64 of the second arm 63, and also a connecting hole 53 facing to the connecting shaft 66 is formed on the bottom surface 52 side of the first arm 43. The connecting shaft 66 is inserted in the connecting hole 53, and the connecting relation is held by a locking pin 68.

The other end portion 51 of the first arm 43 is provided with a wide groove 54 in the circumferential direction thereof. Further, in a bottom portion 55 of the groove 54, a notch window 56 communicating with the connecting hole 53 is formed into a slit shape along the circumferential direction. The notch window 56 is arranged at two places symmetrically with respect to the connecting hole 53. One of these notch windows 56 is shown in FIG. 4. The notch windows 56 regulates a allowable turning range of the second arm 63, and, in this example, each have a length corresponding to approximately 90 degrees with the connecting hole 53 being the center.

Figure 6:
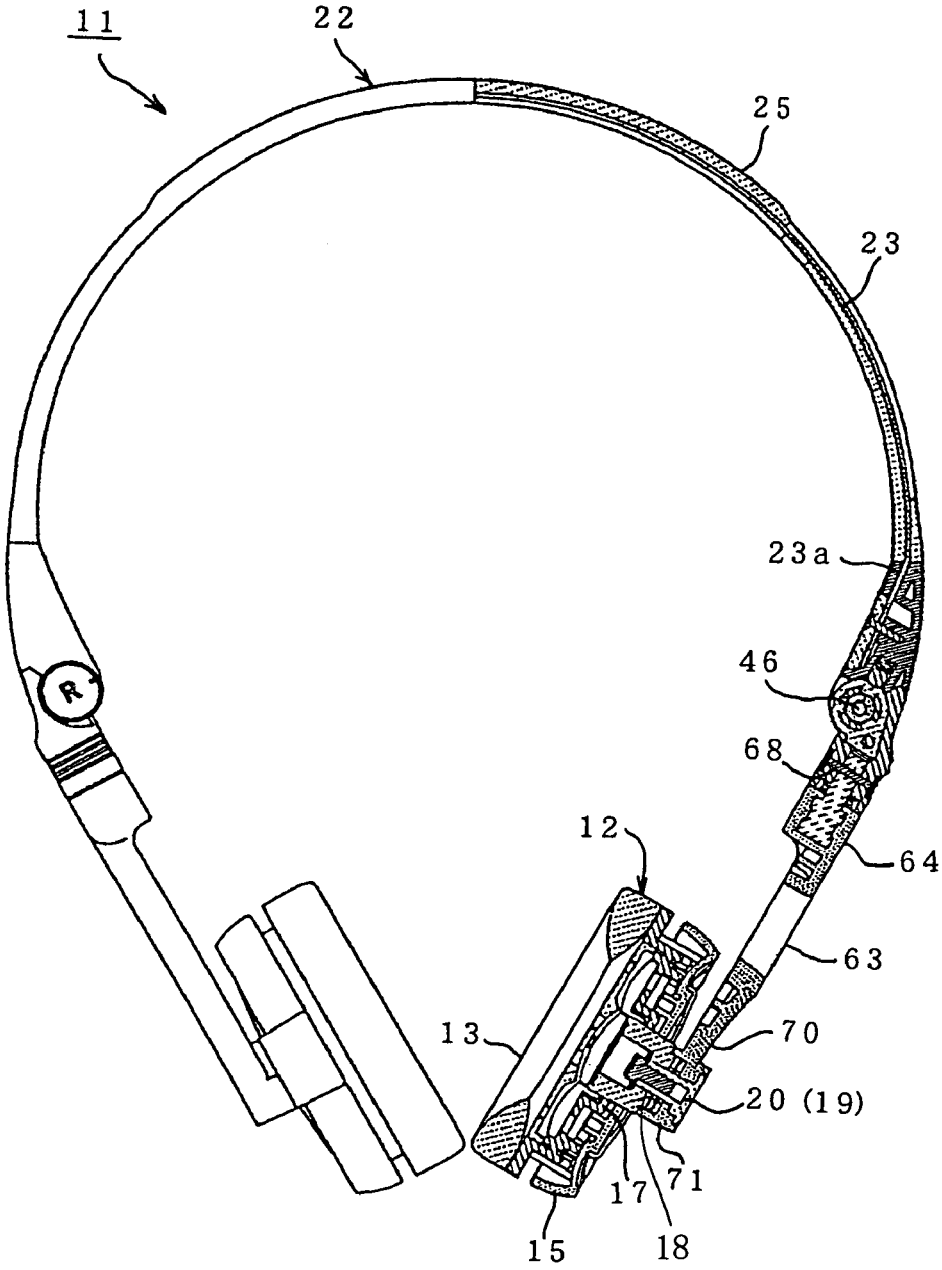
FIG. 6 is a partially sectioned front view of the headphone shown in FIG. 1.

The connecting shaft 66 has an insertion hole 67 formed in a direction perpendicular to the axial direction of the connecting shaft 66. In a state in which the connecting shaft 66 is inserted in the connecting hole 53 and the insertion hole 67 is caused to coincide with the notch windows 56, as shown in FIG. 6, the locking pin 68 such as a spring pin is driven into the insertion hole 67, by which the connecting shaft 66 is connected turnably to the other end portion 51 of the first arm 43.

The locking pin 68 has a length such that pin ends 68*a* on both sides are located within the notch windows 56, and acts as a stopper for regulating the allowable turning range of the second arm 63. That is to say, the second arm 63 can be turned in the range of 90 degrees corresponding to the peripheral length of the notch window 56. It is preferable that a decorative ring 57 be attached to the groove 54 as shown in FIG. 3 to improve the appearance of the connecting portion.

Also, the second arm 63 has a bow-shaped curved portion 69 in an intermediate part ranging from the one end portion 64 to the other end portion 70. When the headphone is in use, the curved portion 69 is preferably directed to the front (front side of human body's ear) as shown in FIG. 2. The one end portion 64 and the other end portion 70 of the second arm 63 are separated more greatly than at least the outside diameter of the headphone unit 12 via the curved portion 69. The curvature of the curved portion 69 may be determined arbitrarily.

In the other end portion 70 of the second arm 63, the headphone unit 12 is supported turnably. The headphone 12 has a casing 15 which has a substantially disc-shaped outline and incorporates a transducer for converting an electrical signal into sound. On the sound radiating surface 14 side of the casing 15, the ear pad 13 is installed.

To support the headphone 12 turnably, as shown in FIGS. 5 and 6, there is provided a bearing portion 71 having a journal hole 72 perpendicular to the lengthwise direction of the curved portion 69.

On the other hand, the casing 15 of the headphone unit 12 is provided with a bearing portion 17 mating with the bearing portion 71. In this case, the bearing portion 17 has a journal hole 18 perpendicular to the sound radiating surface 14, and is provided on the outer peripheral end surface 16 side of the casing 15.

The bearing portion 71 on the second arm 63 side and the bearing portion 17 on the headphone unit 12 side are connected turnably to each other via a connecting means 19 including a support shaft 20. Thereby, the headphone unit 12 can be turned through 360 degrees around the connecting means in a state in which the parallel relation between the sound radiating surface 14 and the second arm 63 is held.

Thereupon, when the elastic band 22 is expanded to the outside from the state shown in FIGS. 1 and 2 and the headphone is mounted, the headphone unit 12 becomes nearly parallel to the ear. By turning the headphone unit 12 around the connecting means 19, the headphone unit 12 can be set at an optimum position at which sound is not heard outside.

Next, one example of a procedure for folding the headphone 11 constructed as described above will be explained with reference to FIGS. 8A to 8C.

As explained above, when the headphone is mounted, as shown in FIGS. 1 and 2, the second arms 63, 63 are turned so that the curved portions 69, 69 are directed forward, and the headphone units 12 are turned in a direction separating from the curved portions 69, 69 so as to match the position of ear.

Figure 8A:
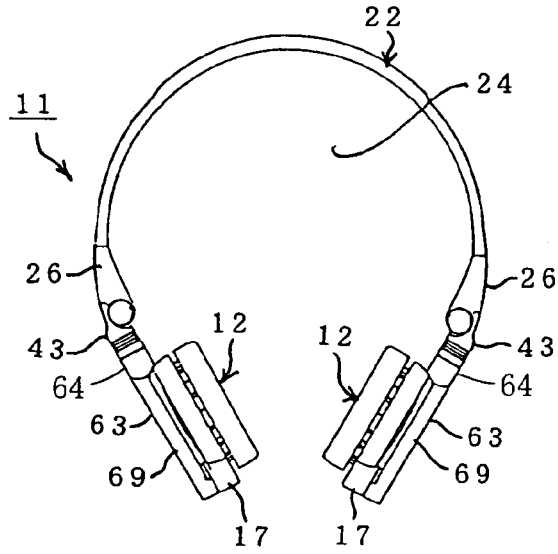
FIG. 8A is an illustrative view for illustrating on example of a folding procedure for the headphone shown in FIG. 1.

In order to fold the headphone 11 in a compact form from this usage mode, first, as shown in FIG. 8A, the headphone units 12, 12 are turned upward (on the one end portion 64 side of the second arm 63), and the curved portions 69, 69 of the second arms 63, 63 are housed.

Figure 8B:
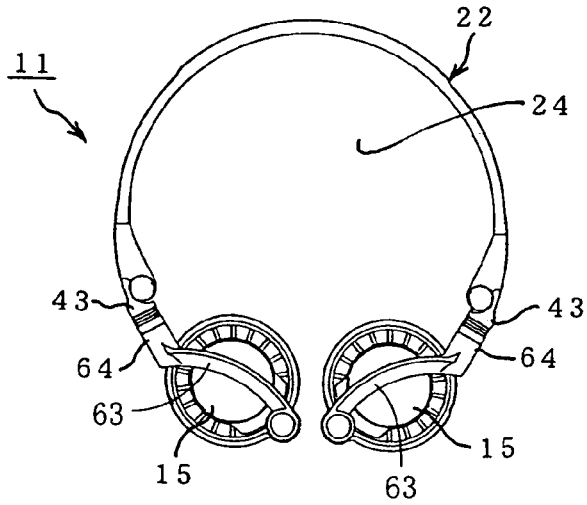
FIG. 8B is an illustrative for illustrating on example of a folding procedure for the headphone shown in FIG. 1.

Next, as shown in FIG. 8B, the second arms 63, 63 are turned through approximately 90 degrees in a direction such that the curved portions 69, 69 come close to each other, namely, toward the inside of the elastic band 22. This turning range is regulated by the notch windows 56 and the pin ends 68*a* of the locking pin 68. Therefore, even if the second arms 63, 63 are turned unconsciously, they are not turned exceeding 90 degrees.

Figure 8C:
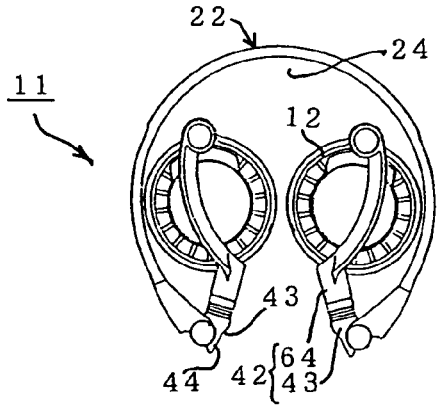
FIG. 8C is an illustrative for illustrating on example of a folding procedure for the headphone shown in FIG. 1.

Next, as shown in FIG. 8C, the second arms 63, 63 is turned together with the first arms 43, 43 toward the internal space 24 of the elastic band 22, and the headphone units 12, 12 are housed in the internal space 24 of the elastic band 22. At this time, since the engagement body 31 of the positioning stopper 47 engages with the other groove 50 with a proper clicking force, the housing state of the headphone units 12 is maintained.

Thus, according to the present invention, when the headphone is not in use, the headphone units 12, 12 can be housed in the internal space 24 of the elastic band 22 and can be stored in a compact state. In order to restore the storage state shown in FIG. 8C to the usage state, the state shown in FIGS. 1 and 2 can be formed easily by reversing the above procedure.

The above is an explanation of the present invention on the basis of an example shown in the drawings, and the configuration is not limited to the above-described example. For example, the elastic band 22 can be formed by only the flexible band portion 23 without the covering portion 25. Also, the flexible band portion 23 itself may be formed of a flexible resin material.

Also, the turning range of the second arm 63 with respect to the first arm 43 can be made narrower or wider than 90 degrees upon request. Further, the turning of the first arm 43 with respect to the elastic band 22 can be permitted freely without especially providing the positioning stopper 47.

Even if the positioning stopper 47 is provided, a construction other than the engagement construction in the example shown in the figures, for example, an appropriate locking construction capable of being unlocked freely or a screwing construction in which a screw is tightened or loosened can be adopted. Further, the second arm 63 can be of a straight shape without providing the curved portion 69 as necessary.

Still further, the thickness of the headphone unit 12 is decreased as far as possible, by which the design can be changed so that the headphone unit 12 is within the transverse width of the elastic band 22 in the finally folded state shown in FIG. 8C. Also, the elastic band 22 can be used not only as the headband system but also as an under band system in which the elastic band 22 is arranged under the chin or as a neck band system in which the elastic band 22 is arranged on the back of the head.

The present application is based on, and claims priority from, Japanese Application Serial Number JP2004-271761, filed Sep. 17, 2004, the disclosure of which is hereby incorporated by reference herein in its entirety.

The invention claimed is:

1. A headphone comprising:

a pair of right and left headphone units, an elastic band formed substantially into a U shape to be mounted on a human head for supporting the headphone units in end portions thereof, and multiaxial arm joints, each being formed between an end part of the elastic band and the headphone unit, and including a first arm having one end connected turnably to the end part of the elastic band, and a second arm having one end connected turnably to the other end of the first arm and the other end connected turnably to the headphone unit, the second arm having a dimension longer than that of the first arm, a curved portion in an intermediate part thereof expanding forward when the headphone is mounted on the head, and turnable connecting means provided between an inside of the other end of the second arm and an outer peripheral end surface of the headphone unit, wherein the one end of the first arm is connected to the end part of the elastic band so that the first arm can be turned toward an internal space of the elastic band, the one end of the second arm is connected to the other end of the first arm so that, in the internal space of the elastic band, a sound radiating surface of an ear pad of the headphone unit can be turned so as to be directed rearward from a position at which the sound radiating surface faces an ear side when the headphone is mounted on the head; and the headphone unit is connected to the other end of the second arm through the turnable connecting means so that the sound radiating surface of the ear pad can be turned along a plane direction when the headphone is mounted on the head, whereby by tuning connecting portions of the multiaxial arm joints, the headphone units are housed within the internal space encircled by the elastic band from a state in which the headphone is mounted on the head.

2. The headphone according to claim 1, further comprising a releasable positioning stopper between the end portion of the elastic band and one end of the first arm for holding the first arm at a turning start position and a turning end position.

3. The headphone according to claim 1 wherein the second arm is connected to the first arm so as to be turnable in a movable range of approximately 90 degrees.

4. The headphone according to claim 1, wherein said multiaxial arm joints further includes a first support shaft arranged between the elastic band and the first arm so that the first arm can rotate toward the internal space, a connecting shaft arranged along an axial direction of the first arm to connect the first arm and the second arm so that the second arm can rotate around the first arm, and a second support shaft arranged between the second arm and the headphone unit so that the headphone unit can rotate relative to the second arm.

5. A headphone comprising:

a pair of right and left headphone units, an elastic band formed substantially into a U shape, which is mounted ranging from a human head to two sides of the head, and supports the headphone units in end portions thereof, a multiaxial arm joint between an end part of the elastic band and the headphone unit and including a first arm, one end of which is connected turnably to the end part of the elastic band, and a second arm, one end of which is connected turnably to the other end of the first arm and the other end of which is connected turnably to the headphone unit, and a releasable positioning stopper between the end portion of the elastic band and the one end of the first arm for holding the first arm at a turning start position and a turning end position, wherein by tuning the connecting portions of the multiaxial arm joint, the headphone units are housed within an internal space encircled by the elastic band from a state in which the headphone is mounted on the head.

* * * * *